United States Patent [19]

Nidola et al.

[11] 4,110,180

[45] Aug. 29, 1978

[54] PROCESS FOR ELECTROLYSIS OF BROMIDE CONTAINING ELECTROLYTES

[75] Inventors: Antonio Nidola, Milan, Italy; Vittorio De Nora, Nassau, The Bahamas; Placido M. Spaziante, Milan, Italy

[73] Assignee: Diamond Shamrock Technologies S.A., Geneva, Switzerland

[21] Appl. No.: 789,216

[22] Filed: Apr. 20, 1977

Related U.S. Application Data

[63] Continuation-in-part of Ser. No. 680,984, Apr. 28, 1976, abandoned.

[51] Int. Cl.[2] ..... C25B 1/24

[52] U.S. Cl. ..... 204/128; 204/290 R; 204/290 F

[58] Field of Search ..... 204/128, 98, 290 R, 204/290 F

[56] References Cited

U.S. PATENT DOCUMENTS

| | | | |
|---|---|---|---|
| 511,682 | 12/1893 | Chalandre | 204/98 |
| 3,809,630 | 5/1974 | De Nora et al. | 204/128 |

FOREIGN PATENT DOCUMENTS

| | | | |
|---|---|---|---|
| 785,723 | 11/1957 | United Kingdom | 204/128 |
| 2,265 of | 1812 | United Kingdom | 204/128 |

OTHER PUBLICATIONS

"Chem. Comp. of Sea Water," Handbook of Chem. & Physics, 32 ed., 1950, p. 2806.

*Primary Examiner*—R. L. Andrews
*Attorney, Agent, or Firm*—Hammond & Littell

[57] ABSTRACT

In a method and apparatus for electrolyzing an aqueous bromide containing electrolyte to form bromine by passing an electrolysis current through said electrolyte between a cathode and an anode comprising at least a valve metal base which is exposed to the electrolyte over at least part of its surface, the improvement comprising maintaining a breakdown voltage at the valve metal base of the anode in excess of 2 volts (NHE) which may be effected, for example, by using a base consisting of a titanium alloy containing up to 10% by weight of at least one member of the group consisting of vanadium, zinc, hafnium, tantalum and niobium or by using a tantalum base or by the addition to the electrolyte of soluble salts of at least one metal of groups IIA, IIIA, IVA, VA, VB, VIIB and VIIIB of the Periodic Table in amounts up to 1% by weight or by the addition to the electrolyte of sulfate and/or nitrate ions in a range of 10 to 10 g/l.

10 Claims, No Drawings

PROCESS FOR ELECTROLYSIS OF BROMIDE CONTAINING ELECTROLYTES

PRIOR APPLICATION

This application is a continuation-in-part of our copending, commonly assigned U.S. patent application Ser. No. 680,984 filed Apr. 28, 1976, now abandoned.

STATE OF THE ART

When film forming metals such as titanium, tantalum, zirconium, niobium and tungsten and alloys of these metals are used as electrodes in an electrolyte under relatively high current density, they quickly form an insulative oxide film on the surface thereof, and the electrolysis current drops to less than 1% of the original value within a few seconds. These metals, which are also called "valve metals," have the capacity to conduct current in the cathodic direction and to resist the passage of current in the anodic direction and are sufficiently resistant to the electrolyte and the conditions within an electrolysis cell used, for example, for the production of chlorine or other halogens or in batteries or fuel cells, to be used as electrodes (anodes or cathodes) in electrochemical processes.

The property of passivating themselves under anodic polarization makes valve metals best suited to be used as corrosion resistant anode bases. The valve metal base is usually provided with an electrocatalytic and electroconductive coating over its active surface. These coatings are usually porous and under anodic polarization the exposed valve metal quickly forms an insulative layer of oxide which prevents further corrosion of the base. Among valve metals, titanium is by far the most used because of its lower cost, good workability and because it offers the best characteristics to bond the electrocatalytic coating thereto.

When electrodes of these film forming metals are provided with an electrically conductive electrocatalytic oxide coating such as described in U.S. Pat. Nos. 3,632,498, 3,711,385 and 3,846,273, they are dimensionally stable and will continue to conduct electrolysis current to an electrolyte and to catalyze halogen discharge from the anodes at high current densities over long periods of time (3 to 7 years) without becoming passivated or inactive, which means that the potential is not above an economical value.

When, however, titanium anodes are used for the discharge of bromine from aqueous electrolytes, the breakdown voltage (BDV) of the insulative valve metal oxide film on the valve metal base is so near the electrode potential at which bromine is discharged at the anodes that the use of commercially pure titanium anodes, as now commonly used for chlorine production, electrowinning, etc., is not possible because the margin of safety of these anodes for bromine release is too low for satisfactory commercial use.

The decomposition potential for bromine from a sodium bromide solution is 1.3–1.4 volts, whereas the breakdown voltage of commercially pure (c.p.) titanium in bromine containing electrolytes is less than 2 V (NHE) at 20° C. This is probably due to a strong absorption of bromide ions on the anode surface, which causes a rise of internal stresses in the passive protective titanium oxide layer which forms in the pores of the electrocatalytic coating and over uncoated areas of the anode surface; or the conversion of the colloidal continuous titanium oxide film into a crystalline, porous, nonprotective titanium oxide; or to an increase of the amount of the electron holes in the titanium oxide film which causes a decrease of the breakdown voltage; or to the formation of $Ti^{III}Br_y$ $(y-3)$- complexes in the anodic film, which hydrolyze producing free HBr (a strong corrosive agent for the titanium); or to a combination of two or more of these actions. Regardless of the reason, the low breakdown voltage, which is very close to the decomposition potential for bromides, does not permit the commercial use of commercially pure titanium for the anodic structures in bromine containing electrolytes because the corrosion of titanium quickly results in the spalling off of the electrocatalytic coating with consequent deactivation of the anode.

OBJECTS OF THE INVENTION

It is an object of the invention to provide an improved process for the electrolysis of aqueous bromide solutions while maintaining the breakdown voltage at the anode in excess of 2 volts (NHE).

It is another object of the invention to provide an improved electrolyte for bromine evolution comprising an aqueous bromide solution containing 10 ppm to 1% by weight of water-soluble salts of at least one metal of groups IIA, IIIA, IVA, VA, VB, VIIB and VIIIB of the Periodic Table.

It is a further object to provide bromide electrolytes containing sulfate and/or nitrate ions in the range of 10 to 100g/l.

Another object is to provide an electrolysis cell in which the anode has a breakdown voltage in bromide electrolytes in excess of 2 volts (NHE).

These and other objects and advantages of the invention will become obvious from the following detailed description.

THE INVENTION

The process of the invention for the electrolysis of aqueous bromide electrolytes with valve metal based anodes comprises maintaining the breakdown voltage on the valve metal base greater than 2 V (NHE).

While commercially pure titanium and other titanium alloys have breakdown voltages in bromide containing electrolytes of less than 2 volts, it has now been found that anodes of titanium alloys containing 0.5 to 10% by weight of tantalum, zinc, vanadium, hafnium or niobium and tantalum and tantalum alloys show a breakdown voltage above 10 volts in sodium bromide solutions which make them excellent anodes for the electrolysis of aqueous bromide solutions.

Another means of maintaining the breakdown voltage of commercially pure titanium based anodes coated with an electrocatalytic coating suitable to discharge bromine ions above 2 volts (NHE) is to add to the aqueous bromide electrolyte 10 to 10,000 ppm of a soluble salt of at least one metal of groups IIA, IIIA, IVA, VA, VB, VIIB and VIIIB of the Periodic Table.

Examples of suitable salts of the metals are water-soluble inorganic salts such as halides, nitrates, sulfates, ammonium, etc., of metals such as aluminum, calcium, magnesium, cobalt, nickel, rhenium, technetium, arsenic, antimony, bismuth, gallium and iridium and mixtures thereof.

One of the preferred aqueous bromide electrolytes of the invention contains 10 to 4,000 ppm of a mixture of salts of aluminum, magnesium, calcium, nickel and arsenic and preferably 500 ppm of aluminum, 1,000 ppm of calcium, 1,000 ppm of magnesium, 50 ppm of nickel and 100 ppm of arsenic, which increases the anode breakdown voltage on commercial titanium from about 1.3–1.4 to about 4.5–5.0 volts (NHE). This higher breakdown voltage makes the electrolyte and commercially pure titanium based anodes useful for the commercial production of bromine by electrolysis of sodium bromide solutions and in other electrolysis processes in which bromide is present in the electrolyte and bromine is formed at the anode.

When noble metal oxide coated anodes of commercially pure titanium, as described in U.S. Pat. Nos. 3,632,498, 3,711,385 or 3,846,273, are used for the eletrolysis of bromide containing solutions, bromine evolution occurs, at 25° C., at a slightly lower anode potential than oxygen evolution. For instance, the potential difference between the desired reaction $$2\,Br^- \rightarrow Br_2 + 2e \qquad (1)$$

and the unwanted oxygen evolution reaction $$2\,OH^- \rightarrow \tfrac{1}{2}\,O_2 + H_2O + 2e \qquad (2)$$

is only about 300 mv at 10 KA/m$^2$ at a sodium bromide concentration of 300 g/liter and this difference decreases at higher temperatures as the temperature coefficient for reaction (1) is more negative than for reaction (2).

The addition of the above metal ions to the aqueous bromide electrolyte appears to catalyze the formation of colloidal continuous titanium oxide films on the titanium under anodic conditions so that the noble metal oxide coated, commercially pure titanium anodes may be used for electrolysis of these electrolytes without the protective titanium oxide film on the anodes being destroyed under the electrolysis conditions.

Some of the elements able to increase the titanium breakdown voltage, in their decreasing order of activity, are the following:

$$Al < Ni, Co < Ca, Mg < Re, Tc < As, Sb, Bi$$

In the case of aluminum, the breakdown voltage at 20° C in electrolysis of an aqueous solution of 300 g/liter of sodium bromide is close to 3.3 V (NHE), whereas at 80° C it is slightly less or above 3.0 V (NHE). There is a threshold value for each element which corresponds to the maximum titanium breakdown voltage.

The effect of aluminum is increased by adding other salts, including nickel and/or cobalt, calcium, magnesium, gallium, indium or arsenic, etc., which produce a synergistic effect. By using a mixture of aluminum (500 ppm) + calcium (1,000 ppm) + magnesium (1,000 ppm) + nickel (50 ppm) + arsenic (100 ppm) in the sodium bromide electrolyte, the breakdown voltage for commercially pure titanium anode bases is above 5.0 V (NHE) at 20° C., whereas at 80° C it is slightly less, or above 4.5 V (NHE).

Water soluble inorganic compounds containing calcium, magnesium, rhenium, aluminum, nickel, arsenic, antimony, etc., increase the breakdown voltage of commercially pure titanium in the bromide containing electrolyte and sharply increase the value of the titanium breakdown voltage.

In another embodiment of the invention, corrosion of commercial titanium anodes, coated with an electrocatalytic coating, in bromide electrolytes, is prevented by adding to the electrolyte sulfate and/or nitrate ions of 10 to 100 g/l preferably 10 to 30 g/l.

In yet another embodiment of the invention, uncoated commercial tantalum is used as an insoluble anode to discharge bromine from aqueous solutions containing bromides. Its breakdown voltage is greater than 10 V (NHE) and uncoated tantalum, contrary to the other valve metals, is catalytic to discharge bromine ions at current densitities up to 300 A/m$^2$.

While the electrolysis of aqueous bromide solutions with bromine formation at the anode is primarily effective for bromine and bromate production, aqueous bromide electrolytes are also found in fuel cells, storage batteries, metal electrowinning and other processes and the invention is useful in all these fields. The normal concentration of bromide in the electrolyte is 50 to 300%.

In the following examples there are described several preferred embodiments to illustrate the invention. However, it should be understood that the invention is not intended to be limited to the specific embodiments.

EXAMPLE 1

An aqueous solution of 300 g per liter of sodium bromide was electrolyzed at 20° and 80° C and a current density of 10 KA/m$^2$ in an electrolysis cell provided with a cathode and an anode of commercially pure titanium provided with a mixed coating of ruthenium oxide and titanium oxide. Various additives as reported in Table I were added thereto and the breakdown voltage was determined in each instance and the results are reported in Table I.

TABLE I

| Additive | | B.D.V. | (V(NHE)) |
|---|---|---|---|
| Type | Amount (ppm) | 20° C | 80° C |
| | 10 | 3.0 | 2.3 |
| $AlCl_3$ | 500 | 3.1 | 3.0 |
| | 1000 | 3.3 | 3.0 |
| | 10 | 2.0 | 2.0 |
| | 100 | 2.3 | 2.2 |
| $NiBr_2$ | 500 | 2.4 | 2.3 |
| $CoBr_2$ | 100 | 2.4 | 2.3 |
| | 100 | 2.0 | 1.9 |
| $CaBr_2$ | 1000 | 2.2 | 2.1 |
| | 2000 | 2.3 | 2.2 |
| $MoBr_2$ | 4000 | 2.3 | 2.2 |
| | 10 | 2.0 | 2.0 |
| $(NH_4)ReO_4$ | 50 | 2.1 | 2.0 |
| $(NH_4)TcO_4$ | 50 | 2.0 | 2.0 |
| | 10 | 1.9 | 1.8 |
| $As_2O_3$ | 100 | 2.2 | 1.9 |
| | 500 | 2.2 | 2.0 |
| $Sb_2O_3$ | 100 | 2.1 | 2.0 |
| $Bi_2O_3$ | 100 | 2.0 | 2.0 |
| Al(500) + Ca(1000) + Mg(1000) | | 4.0 | 3.8 |
| Al(500) + Ni(100) + As(100) | | 3.8 | 3.6 |
| Al(500) + Ca(1000) + Mg(1000) + Ni(100) + As(100) | | 5.0 | 4.5 |
| Al(500) + Pyrrole(100) | | 3.4 | 3.0 |
| Al(500) + Pyridine(50) | | 3.1 | 3.0 |
| Al(500) + Butyl amine (100) | | 3.2 | 3.1 |
| c.p. Titanium | — | 1.4 | 1.3 |

EXAMPLE 2

An aqueous solution of 200 g/l of sodium bromide with a pH of 4.8 was electrolyzed in the cell of Example 1 at 25° C without stirring at a current density ranging from 1 to 10 MA/cm$^2$. Test ions $Pb^{4+}$, $Sb^{3+}$, $As^{3+}$ and $VO^{++}$ were added to the electrolyte in a concentration ranging from 10 to 100 ppm and in all instances, the titanium corrosion was improved as compared to the electrolyte without the additives.

EXAMPLE 3

An electrolysis similar to Example 1 was performed without additives except that the anode base was not commercially pure titanium but tantalum, an alloy of titanium containing 5% by weight of niobium and an alloy of titanium containing 5% by weight of tantalum. In each instance, the breakdown voltage was greater than 10 volts.

EXAMPLE 4

An aqueous solution of 300 grams per liter of sodium bromide was electrolyzed at 20° C at the current densities of 1 KA/m², 5 KA/m² and 10 KA/m² in an electrolysis cell provided with an anode of commercially pure titanium provided with a mixed coating of ruthenium oxide and titanium oxide and a cathode. The results of the life tests performed on the anode with and without additives to the electrolyte are reported in Table II.

TABLE II

| Type of Additive(s) | Amount of Additive(s) ppm | Working time (hours) at current density 1 KA/m² | 5 KA/m² | 10 KA/² | Titanium Corrosion g/m² |
|---|---|---|---|---|---|
| None | — | 600 | | | Nil |
| | | | 600 | | 0.5 |
| | | | | 300 | failed |
| $AlCl_3$ | 1000 | 600 | | | Nil |
| | | | 600 | | Nil |
| | | | | 600 | <0.1 |
| $AlCl_3$; | 500 | 600 | | | Nil |
| | | | 600 | | Nil |
| $CaBr_2$; | of | | | 600 | Nil |
| $MgBr_2$ | each | | | | |
| $AlCl_3$; | 1000; | 600 | | | Nil |
| $CaBr_2$; | 500; | | 600 | | Nil |
| | | | | 600 | Nil |
| $MgBr_2$; | 500; | | | | |
| $NiBr_2$; | 100; | | | | |
| $As_2O_3$ | 100; | | | | |

EXAMPLE 5

An aqueous solution of 300 grams per liter of sodium bromide was electrolyzed at 20° C at varying current densities in an electrolysis cell provided with a cathode and anodes consisting of commercially pure titanium, alloys of titanium containing respectively 2.5, 5 and 10% by weight of tantalum and an alloy of titanium containing 10% of niobium. All anodes tested were provided with a coating of mixed oxides of ruthenium and titanium. The results of life tests performed on the anodes are reported in Table III.

TABLE III

| Anode Base Material | Working time (hours) at current densities 1 KA/m² | 5 KA/m² | 10 KA/m² | Anode Corrosion g/m² |
|---|---|---|---|---|
| Ti c.p. | 600 | | | Nil |
| | | 600 | | 1 |
| | | | 300 | failed |
| Ti—Ta (2.5) | 600 | | | Nil |
| | | 600 | | Nil |
| | | | 600 | slight |
| Ti—Ta (5) | 600 | | | Nil |
| | | 600 | | Nil |
| | | | 600 | slight |
| Ti—Ta (10) | 600 | | | Nil |
| | | 600 | | Nil |
| | | | 600 | Nil |
| T—Nb (10) | 600 | | | Nil |
| | | 600 | | Nil |
| | | | 600 | Nil |

Similar results are obtained with anodes made of titanium containing 5% tantalum and 1% vanadium and titanium containing 0.5% of tantalum.

EXAMPLE 6

An aqueous solution of 200 grams per liter of sodium bromide was electrolyzed at 20° C at varying current densities in an electrolysis cell provided with a cathode and anodes consisting of (a) commercially pure titanium coated with mixed oxides of ruthenium and titanium, (b) commercially pure tantalum coated with mixed oxides of ruthenium and titanium or (c) commercially pure tantalum without coating. The test results are reported in Table IV.

TABLE IV

| Anode | Working time (hours) at current densities 1 KA/m² | 5 KA/m² | 10 KA/m² | Anode Corrosion g/m² | Anodic Potential V(NHE) |
|---|---|---|---|---|---|
| Ti c.p. coated | 600 | | | Nil | 1.25 |
| | | 600 | | 1 | to |
| | | | 300 | failed | 1.45 |
| Ta c.p. coated | 600 | | | Nil | 1.25 |
| | | 600 | | Nil | to |
| | | | 600 | Nil | 1.55 |
| | 100 A/m² | 250 A/m² | 500 A/m² | | |
| Ta c.p. uncoated | 600 | | | Nil | 1.6 |
| | | 600 | | Nil | to |
| | | | 600 | Nil | 1.8 |

The performed tests indicate also that the adherence of the anodic oxide coatings to anode bases of tantalum and titanium alloys containing tantalum and niobium is not as good as on commercially pure titanium anode bases. Under favorable economic conditions, these more expensive titanium alloys or tantalum bases may be safely used for bromine release. However, in different circumstances, the use of commercially pure titanium anode bases with the addition to the electrolyte of compounds raising the BDV of titanium in bromide solutions may represent a more economical choice.

Commercially pure tantalum, titanium and niobium uncoated anodes have also been tested and it has surprisingly been found that, of the three valve metals, tantalum is most suitable for discharging bromine, although at rather low current densities. A maximum allowable steady state current density may put at about 250–300 A/m² and this may still be satisfactory for special application such as in life support apparatus.

EXAMPLE 7

Comparative accelerated life tests were performed on anodes of commercial titanium coated with a coating of mixed oxides of ruthenium and titanium. The conditions of the two test runs were as follows:

(i) Pure bromide solution

| | |
|---|---|
| NaBr | 100 g/l |
| Temperature | 60° C |
| Anode current density | 15 KA/m² |
| Working time | 10 minutes |

(ii) Bromide containing sulfates

| | |
|---|---|
| NaBr | 100 g/l |
| $Na_2SO_4$ | ≧160 g/l |
| Temperature | 60° C |
| Anode current density | 15 KA/m² |
| Working time | 1 hour |

Metallographic analysis carried out on the sample anodes indicated that severe corrosion of the titanium substrate, in the case of pure bromide electrolytes, had taken place after 10 minutes of electrolysis. Conversely, the anodes which had operated for over one hour in electrolytes containing a substantial amount of sulfate ions did not show any sign of corrosion.

EXAMPLE 8

Comparative accelerated life tests were performed on anodes of commercial titanium provided with a coating of ruthenium oxide-titanium oxide. The electrolysis of was effected with an aqueous solution of 200 g/l of sodium bromide at 25° C at a pH of 4.8 with and without the addition of 10 or 30 g/l of sodium nitrate. The metallographic analysis of the anodes showed that the breakdown voltage of the anodes was sharply increased with a corresponding reduction in the corrosion.

A second series of tests were conducted under the same conditions with no additive, 30 g/l of $NaNO_3$, 30 g/l of $Na_2SO_4$ and a mixture of 30 g/l of $NaNO_3$ and 30 g/l of $Na_2SO_4$. The results showed that the addition of either sulfate ions and nitrate ions increased the breakdown voltage while the addition of both ions together showed a synergistic increase in the breakdown voltage.

Various modifications of the compositions and processes of the invention may be made without departing from the spirit or scope thereof and it is to be understood that the invention is intended to be limited only as defined in the appended claims.

We claim:

1. In the method of electrolyzing an aqueous electrolyte containing bromide ions to form bromine in an electrolysis cell equipped with a cathode and an anode comprising at least a valve metal base, the improvement comprising the valve metal base being titanium alloyed with at least one member of the group consisting of tantalum, niobium, hafnium, vanadium and zinc in an amount effective to maintain in the electrolyte a breakdown voltage at the anode base in excess of 2 volts (NHE).

2. The method of claim 1 wherein the valve metal base is an alloy of titanium containing 0.5 to 10% by weight of at least one member of the group consisting of tantalum, niobium, hafnium, vanadium and zinc.

3. In the method of electrolyzing an aqueous electrolyte containing bromide ions to form bromine in an electrolysis cell equipped with a cathode and an anode with a valve metal base, the improvement comprising maintaining in the electrolyte an amount of at least one soluble salt of at least one metal of groups II, IIIA, IVA, VA, VB, VIIB and VIIIB of the Periodic Table sufficient to maintain the breakdown voltage at the anode base in excess of 2 volts (NHE).

4. The method of claim 3 wherein the valve metal base is commercially pure titanium with a coating containing a platinum group metal oxide and the electrolyte contains 10 to 10,000 ppm of the soluble salt.

5. The method of claim 3 wherein the valve metal base is commercially pure titanium provided with a coating containing a platinum group metal oxide and the electrolyte contains sulfate and/or nitrate ions in a concentration of 10 to 100 g/l.

6. The method of claim 3 wherein the electrolyte contains soluble inorganic salts of a metal selected from the group consisting of aluminum, calcium, magnesium, cobalt, nickel, rhenium, technetium, gallium, iridium, arsenic, antimony and bismuth and mixtures thereof.

7. The method of claim 3 wherein electrolyte contains a soluble inorganic salt of aluminum.

8. The method of claim 3 wherein the electrolyte contains soluble inorganic salts of aluminum in amounts of approximately 500 ppm, of calcium in amounts of approximately 1,000 ppm, of magnesium in amounts of approximately 1,000 ppm, of nickel in amounts of approximately 50 ppm and of arsenic in amounts of approximately 100 ppm.

9. In the method of electrolyzing an aqueous electrolyte containing bromide ions to form bromine in an electrolysis cell equipped with a cathode and an anode with a valve metal base, the improvement comprising maintaining in the electrolyte an amount of sulfate and/or nitrate ions effective to maintain the breakdown voltage at the anode base in excess of 2 volts (NHE).

10. In the method of electrolyzing an aqueous electrolyte containing bromide ions to form bromine in an electrolysis cell equipped with an cathode and an anode with a valve metal base, the improvement comprising the valve metal base is uncoated commercially pure tantalum having a breakdown voltage in the electrolyte in excess of 2 volts (NHE) and the steady state anodic current density is below 350 $A/m^2$.

* * * * *